US007615173B2

(12) United States Patent
Van Trump

(10) Patent No.: US 7,615,173 B2
(45) Date of Patent: Nov. 10, 2009

(54) PROCESS FOR PREPARING BICOMPONENT FIBERS HAVING LATENT CRIMP

(76) Inventor: James Edmond Van Trump, 302 River Rd., Apt. A3, Wilmington, DE (US) 19809

( * ) Notice: Subject to any disclaimer, the term of this patent is extended or adjusted under 35 U.S.C. 154(b) by 1267 days.

(21) Appl. No.: 10/719,607

(22) Filed: Nov. 21, 2003

(65) Prior Publication Data

US 2004/0247868 A1 Dec. 9, 2004

Related U.S. Application Data

(60) Provisional application No. 60/427,998, filed on Nov. 21, 2002.

(51) Int. Cl.

| | |
|---|---|
| ***D01D 5/22*** | (2006.01) |
| ***D01D 5/32*** | (2006.01) |
| ***D01D 5/34*** | (2006.01) |
| ***D01F 8/14*** | (2006.01) |
| ***D02G 1/00*** | (2006.01) |

(52) U.S. Cl. ..... 264/168; 264/172.14; 264/172.15; 264/172.17; 264/210.2; 264/211.17; 264/234

(58) Field of Classification Search ..... 264/168, 264/172.14, 172.15, 172.17, 210.2, 211.17, 264/234

See application file for complete search history.

(56) References Cited

U.S. PATENT DOCUMENTS

| | | | |
|---|---|---|---|
| 3,454,460 | A | 7/1969 | Bosley et al. |
| 3,626,442 | A | 12/1971 | Haseley et al. |
| 3,671,379 | A | 6/1972 | Evans et al. |
| 2002/0025433 | A1 | 2/2002 | Chang et al. |
| 2003/0052436 | A1 | 3/2003 | Koyanagi et al. |

FOREIGN PATENT DOCUMENTS

| | | | |
|---|---|---|---|
| EP | 1059372 | A | 12/2000 |
| EP | 1059372 | A2 | 12/2000 |
| GB | 1294723 | A | 11/1972 |
| JP | 11-158733 | | 6/1999 |
| JP | 2001-288620 | | 10/2001 |
| JP | 2002-61029 | | 2/2002 |
| JP | 2002-054029 | A | 6/2002 |
| WO | WO 02/086211 | A | 10/2002 |
| WO | WO 02/086211 | A1 | 10/2002 |

OTHER PUBLICATIONS

Encyclopedia of Polymer Science and Engineering, vol. 11, 2nd Edition, Peroxy Compouds to Polyesters, pp. 433-445.

International Search Report International Application No. PCT/US 03/37673 Date of Mailing: Jul. 19, 2004.

*Primary Examiner*—Leo B Tentoni
(74) *Attorney, Agent, or Firm*—Christina W. Geerlof

(57) ABSTRACT

The present invention is directed to a process for preparing bicomponent fibers by melt spinning two semi-crystalline polymers differing in crystallization rate.

8 Claims, 6 Drawing Sheets

PROCESS FOR PREPARING BICOMPONENT FIBERS HAVING LATENT CRIMP

FIELD OF THE INVENTION

The present invention is directed to a process for preparing bicomponent fibers by melt spinning two semi-crystalline polymers differing in crystallization rate.

BACKGROUND OF THE INVENTION

Numerous examples of bicomponent fibers, particularly bicomponent polyolefin and bicomponent polyester fibers, and the processes for preparing them are known in the art. See, for example, *The Encyclopedia of Polymer Science and Engineering,* 3r ed., Vol. 11, pp 433ff.

Aranaga et al, Japanese Kokai Heisei 11-158733 discloses a bicomponent fiber of polyethylene terephthalate/polypropylene terephthalate (PET/PPT) having latent crimp. It is recognized in Aranaga and elsewhere that high recovery crimped fibers have potential for preparation of high value non-wovens.

Kakumoto et al, Japanese Kokai P2001-288620 discloses a process for preparing bicomponent fibers from two PET polymers differing in melt viscosity spun at speeds of 2,200 to 4,800 m/min then spun drawn in a separate stage and wound to produce a bicomponent fiber having latent crimp.

Tsuboi et al, Japanese Kokai P2002-61029 discloses a process for preparing a PET/PPT bicomponent fiber spun at 3000 m/min. The yarn so prepared is subject to a post-drawing step to realize crimp.

The art of spinning bicomponenet fibers is well-established. For example, U.S. Pat. No. 3,671,379 discloses the spinning of bicomponent polyester fibers, the equipment for accomplishing the spinning, and the design of the spinneret required to provide the desired product.

SUMMARY OF THE INVENTION

The present invention is directed to a process for preparing polyester bicomponent fibers the process consisting essentially of combining at least two crystallizable polyester polymers, melting said polyester polymers, causing said molten polymers to flow through a spinneret having one or more apertures, said spinneret being suitable for preparing bicomponent fibers, thereby spinning at least one strand of 0.5 to 6 denier fiber said strand being spun at a linear rate of ±10% of the maximum shrinkage spinning rate, said two crystallizable polyester polymers differing from one another in crystallization rate under the spinning conditions.

DETAILED DISCUSSION OF THE INVENTION

Figure 1:
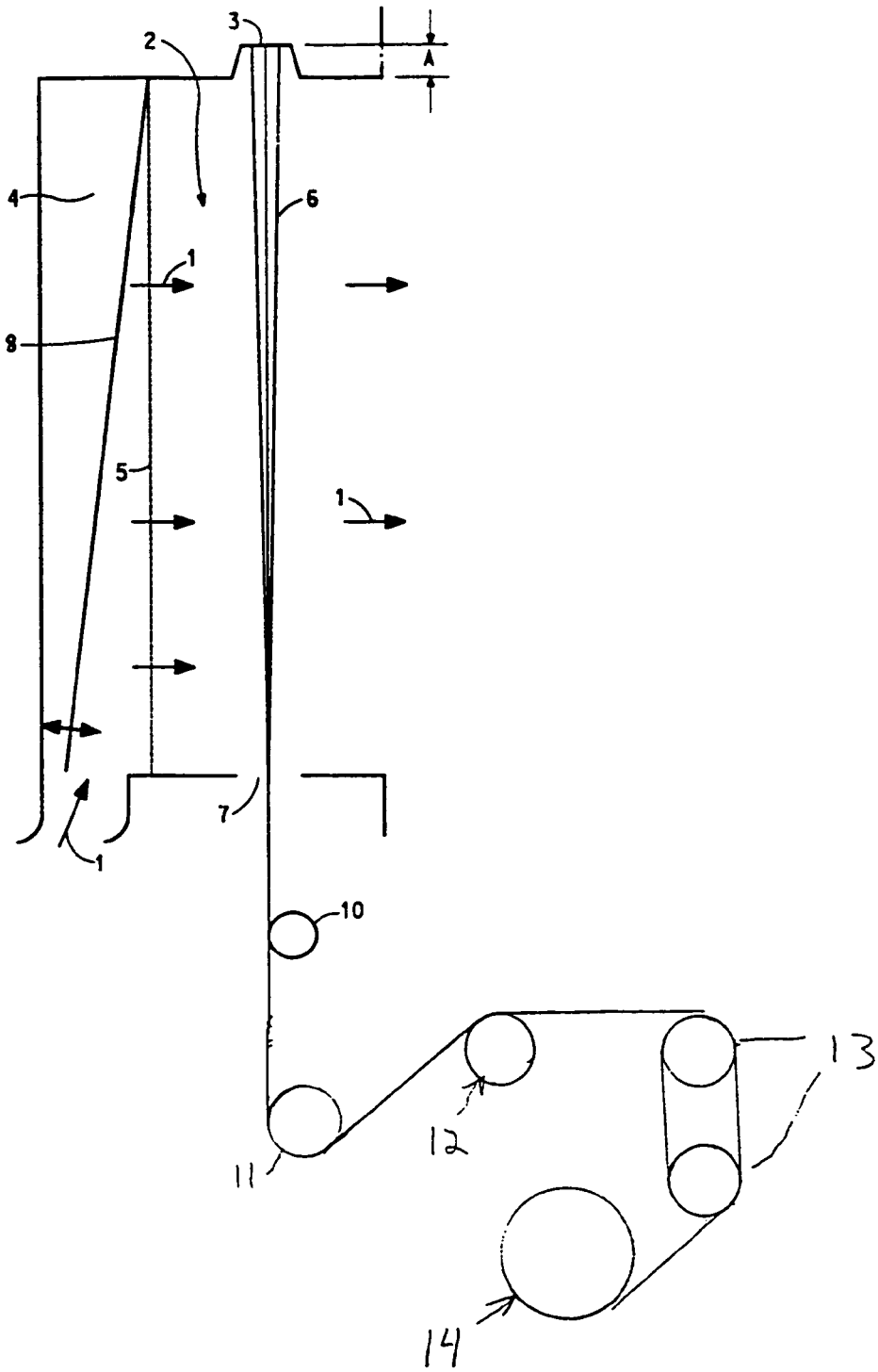
FIG. 1 illustrates one embodiment of a crossflow quench melt-spinning apparatus which is useful in the process of the invention.

The bicomponent fibers prepared from semi-crystalline polyesters according to the present invention are characterized by having unexpectedly high latent shrinkage and a high degree of latent crimp in the as spun fiber without the need for any additional processing stages such as a drawing step, annealing step or any such other steps as are taught in the art to be necessary to realize fibers having high latent crimp. The as-spun fiber prepared according to the present invention exhibits little or no crimp making it highly suitable for use in fabrication of non-woven and conventional woven and knit textile goods. Upon completion of the fabrication step, the latent shrinkage and crimp can be developed to provide high density textile goods with excellent stretch and recovery.

It is well known in the art to prepare bicomponent fibers from polymers which differ in crystallization rate. However, the art does not teach or suggest that a fiber having high latent shrinkage and high latent crimp can be prepared by spinning bicomponent fibers from two crystallizable polyesters differing from one another in rate of crystallization when spun at the maximum shrinkage spinning rate (MSSR). The reason for this is that it has not heretofore been known that there exists a MSSR in the spinning of bicomponent fibers of two crystallizable polyesters.

For the purposes herein, the maximum shrinkage spinning rate (MSSR) is defined as that spinning speed at which the fiber so produced exhibits a higher degree of latent shrinkage than fiber produced at spinning speeds which differ by at least ±10% from the MSSR. As shown hereinbelow, the MSSR is a local maximum such that lower shrinkage fiber is produced at spinning rates both higher and lower than the MSSR.

The present invention is not limited by any particular scientific explanation of the process hereof. However, it is believed by the inventor hereof that when spinning a bicomponent fiber from two crystallizable polyesters differing in crystallization rate under the conditions of spinning the existence of an MSSR depends fundamentally upon that difference in rate of crystallization. At spinning speeds less than 10% lower than the MSSR, especially less than 20% lower, there is insufficient orientation set into the less crystalline polymer to afford significant shrinkage upon later heating, and little crimp is developed. At spinning speeds greater than 10% higher than the MSSR, especially greater than 20% higher, sufficient orientation is imposed upon both polymers that crystallization may occur in both polymers, leaving an insufficient differential in degree of crystallinity. Then upon later heating little shrinkage occurs, and little crimp is developed. However, in the vicinity of the MSSR, both polymers undergo orientation, but the degree of orientation is sufficient to induce significant crystallization in only one of the polymers while the other is oriented but much less crystalline. Upon heating above the glass transition temperature of the lower crystallinity polymer, the lower crystallinity polymer undergoes high shrinkage while the higher crystallinity polymer does not, thereby creating a highly crimped fiber.

One of skill in the art will appreciate that the combined effects of many variables will determine the particular value of the MSSR under any given specific conditions. Among the variables which will have an effect on the specific value of MSSR as well as the size of the shrinkage and crimp contraction maxima, are included the ratio of crystallization rates of the two polymers, the absolute magnitude of the crystallization rate of the faster-to-crystallize component, the thickness or denier of the fiber being produced, the spinning temperature, and the type of quench imposed on the moving fiber line. As will be seen in the Examples hereinbelow, differences in polymer crystallization rate result in large differences in MSSR when other variables are fixed.

The bicomponent fibers prepared according to the process of the present invention are asymmetric in cross-section, being either side-by-side bicomponent fibers, or sheath-core bicomponent fibers wherein the longitudinal axes of the sheath and the core are not coincident. In one embodiment, the two components are present in substantially constant ratio in the filament cross-section; while in another embodiment the components vary in cross-sectional ratio. It is preferred in the practice of the present invention that the components are present in a constant ratio throughout the length of the fiber. Preferably, the component polymer will be present in the spun fiber in a side-by-side relationship.

In the process of the invention, the weight ratio of the two polyesters in the bicomponent fibers made by the process of the invention is in the range of 30/70-70/30, preferably 40/60-60/40, and more preferably 45/55-55/45.

In a preferred embodiment of the present invention, the two polyesters used in the process of the present invention have different compositions. Preferred compositions include PET/PPT, PET/Poly (butylene terephthalate) (PBT), and PPT/PBT, with PET/PPT most preferred. Preferably the two components differ in intrinsic viscosity. Other polyesters suitable for use in the present invention include poly(ethylene 2,6-dinaphthalate, poly(trimethylene 2,6-dinaphthalate), poly(trimethylene bibenzoate), poly(cyclohexyl 1,4-dimethylene terephthalate), poly(1,3-cyclobutane dimethylene terephthalate), and poly(1, 3-cyclobutane dimethylene bibenzoate).

It is advantageous for the polymers to differ both with respect to intrinsic viscosity and composition, for example, in the preferred combination of PET and PPT, the PET preferably is characterized by an IV of equal to or less than about 0.80 dl/g and the PPT is characterized by an IV equal to or greater than about 0.85 dl/g. Nevertheless, the two polymers must be sufficiently similar to adhere to each other; otherwise, the bicomponent fiber will split into two fibers.

The as-spun bicomponent fiber made by the present process exhibits no significant crimp. The term "no significant crimp" is intended to encompass that situation in which the crimp frequency (number of crimps per unit length) is smaller than 10% of the total number of crimps per inch in the fiber after crimp development. Preferably the as-spun bicomponent fiber exhibits no crimp. Crimp can be developed upon exposure to heat in a substantially relaxed state—the term "substantially relaxed" is intended to allow for the yarn to be under light tension, as for example when the 1.5 g weight is suspended from the yarn bundle in the description hereinbelow of how crimp contraction is determined. If the fiber is under excessive tension, crimp development and shrinkage will be constrained, and the fiber is more likely to be heat set, with concomitant reduction or elimination of latent crimp. Final crimp development can be attained under dry heat or wet heat conditions.

Fibers spun at spinning speeds in the range of 10% of the MSSR exhibit a highly desirable combination of an as-spun fiber having little or no crimp, and a realizable shrinkage which, in a preferred embodiment, equals or exceeds 40%. Fibers produced according to the process of the invention are quite useful in, e.g., the preparation of non-woven goods requiring low crimp fibers having high latent crimp with good recovery.

One of the benefits of the latent crimp fibers prepared according to the present invention is that after the crimp has been developed, the fiber may be subject to annealing to induce crystallization in the non-crystallized portion of said crimped fiber thereby stabilizing the crimp and enhancing crimp recovery after stretching.

Selection of polymers to combine for the purpose of practicing the process of the present invention is advantageously performed by comparing the rate of crystallization of the candidates therefor. One method for making the determination of crystallization rate found to be convenient in the practice of the present invention is to employ the methods of differential scanning calorimetry (DSC) as described in ASTM D3418-82 to determine the isothermal crystallization rate curves of each candidate material over the same range of temperatures corresponding to the anticipated spinning conditions. By selecting polymers and processing temperatures to emphasize the difference in crystallization rate, the benefits of the present invention will be realized. Specific examples of the method for determining isothermal crystallization rate and a comparison of specific polymers are presented hereinbelow.

In one embodiment of the process of the invention, two compositionally different polyesters are melt-spun from a spinneret to form a bicomponent fiber. According to the process disclosed in U.S. Pat. No. 3,671,379. Either post-coalescence or pre-coalescence spinnerets can be used.

FIG. 1 illustrates one embodiment of a crossflow quench melt-spinning apparatus which is useful in the process of the invention. Quench gas 1 enters zone 2 below spinneret face 3 through plenum 4, past hinged baffle 18 and through screens 5, resulting in a substantially laminar gas flow across still-molten fibers 6 which have just been spun from capillaries (not shown) in the spinneret. Baffle 18 is hinged at the top, and its position can be adjusted to change the flow of quench gas across zone 2. Spinneret face 3 is recessed above the top of zone 2 by distance A, so that the quench gas does not contact the just-spun fibers until after a delay during which the fibers may be heated by the sides of the recess. (In an alternative embodiment of the apparatus in FIG. 1, the spinneret face is not recessed.) The quench gas, which can be heated if desired, continues on past the fibers and into the space surrounding the apparatus. Only a small amount of gas can be entrained by the moving fibers which leave zone 2 through fiber exit 7. In one embodiment of the process of the invention, finish is applied to the now-solid fibers by a finish roll 10. After exiting from the quench zone, 2, and passing over the finish roll if desired, the fibers are directed, possibly via one or more guide rolls, shown as 11 and 12, to feed rolls, 13. The speed of the feed rolls determines and is substantially equal to the linear speed of spinning. From the rolls 13 the yarn is passed, possibly via one or more additional guide rolls (not shown) to the wind-up, 14.

When cross-flow, radial flow or the like flow of gas is used, the withdrawal speed according to the process of the present invention is in the range of about 500-5,000 meters per minute. When co-current quench gas flow is used (not illustrated), the withdrawal speed according to the process of the invention is in the range of about 820-6,000 meters per minute.

Spinning may be accomplished by any method known in the art for preparing bicomponent fibers. The disclosures of U.S. Pat. No. 3,671,379 are particularly relevant in this regard.

Figure 2:
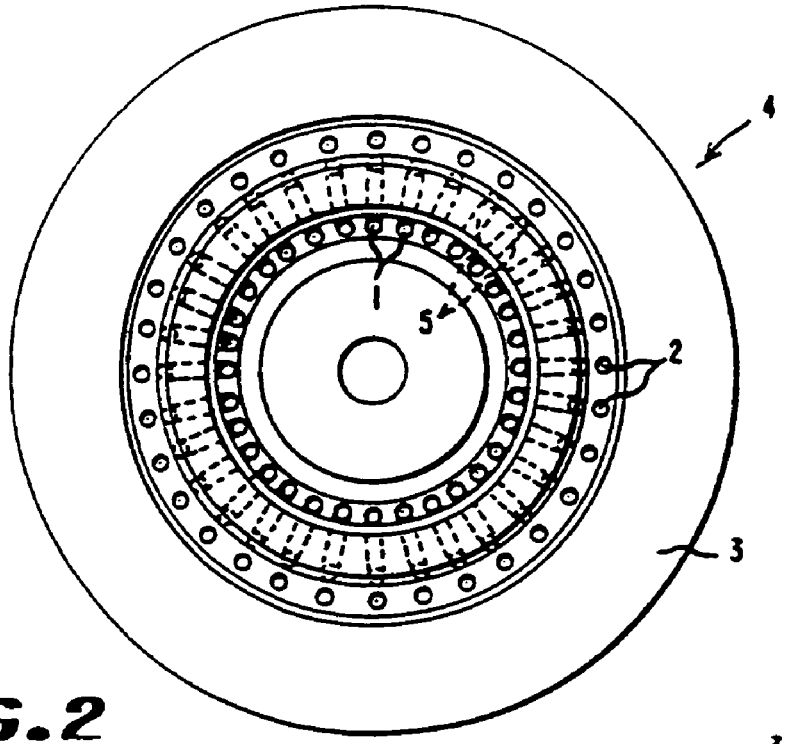
FIG. 2 shows the back face of a spinneret useful in the process of the invention.
Figure 3:
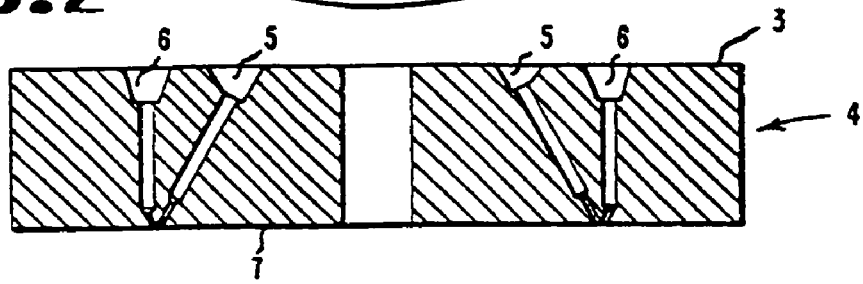
FIG. 3 shows the cross-sectional view of a spinneret useful in the process of the invention.

In one embodiment of the process of the invention, referring to FIG. 2, two polyester melts are separately metered (by means not shown) into the two rings of holes designated as 1 and 2 in the back face, 3, of spinneret, 4. Referring to FIG. 3, a sealing means (not shown) prevents mingling of the two melts at the back face 3 of spinneret 4. Still referring to FIG. 3, the two melts flow through individual channels 5 and 6 to the front face 7 of spinneret 4 where they merge into a side-by-side composite filament as they leave the spinneret assembly. The extruded yarn bundle then is drawn down and quenched and wound up as indicated in FIG. 1.

EXAMPLES

Isothermal crystallization rates of the polymers employed in the specific embodiments hereinbelow, were determined. Each was determined independently at the temperatures indicated in Table 1, and then the results were combined to provide the graphical comparison shown in FIG. 4.

A 6-8 mg specimen of the PET was heated in a Perkin-Elmer (P-E) DSC-7, differential scanning calorimeter, controlled by an Intercooler II, from 50° C. to 285° C. at 50° C./min rate, held at 285° C. for 3 minutes, cooled at 200° C./min to one of the crystallization temperatures between 150° C. and 225° C. as indicated in Table 1. The specimen was held at the specified temperature for 10-60 minutes, until crystallization was complete. A further 6-8 mg specimen of the 2GT was heated to 285° C. for 3 minutes, then quenched in liquid nitrogen temperature. The quenched samples were transferred to a P-E DSC-7 standing at 30° C. The sample was then heated at 200° C./min rate to one of the crystallization temperatures between 130° C. and 160° C. as indicated in Table 1. The specimen was held at the specified temperature for 40 minutes until crystallization was complete. In each case, the time, $t_{1/2}$, required for crystallization to have proceeded halfway was determined from the data.

A 6-8 mg of the PPT was heated in the P-E DSC-7 from 50° C. to 260° C. at 50° C./min rate, held for 3 minutes, and cooled at 200° C./min rate to one of the crystallization temperatures between 100° C. and 200° C. as indicated in Table 1. The specimen was held at the specified temperature for 10-60 minutes until crystallization was complete. A further 6-8 mg specimen of the PPT was heated to 285° C. and held for 3 minutes, followed by quenching in liquid nitrogen as for the PET specimen. However, extra care was taken to use hot tweezers when transferring the specimen into the liquid nitrogen in order to avoid potential partial quenching by contact with cold tweezers. The quenched PPT specimen was transferred to a P-E DSC 7 standing at 5° C. using cold tweezers, and then heated at 200° C./min to a crystallization temperature between 60° C. and 65° C. and indicated in Table 1. The specimen was held at the specified temperature for 40 minutes until crystallization was complete.

A 6-8 mg specimen of the PBT was heated in a P-E DSC-7 from 50° C. to 260° C. at 50° C./min rate, held for 3 minutes, and cooled at 200° C./min rate to one of the crystallization temperatures between 150° C. and 200° C. as indicated in Table 1. The specimen was held at the specified temperature for 10-60 minutes until crystallization was complete. A further 6-8 mg specimen of the PBT was heated in a thermogravimetric analysis pan and quenched to liquid nitrogen temperature with touching the sample with tweezers. The quenched PBT was transferred to a standing P-E DSC 7 at −10° C. using chilled tweezers. The specimen was heated at 200° C./min rate to one of the crystallization temperatures between 37° C. and 45° C. as indicated in Table 1. The specimen was held at the specified temperature for 40-60 minutes until crystallization was complete.

Figure 4:
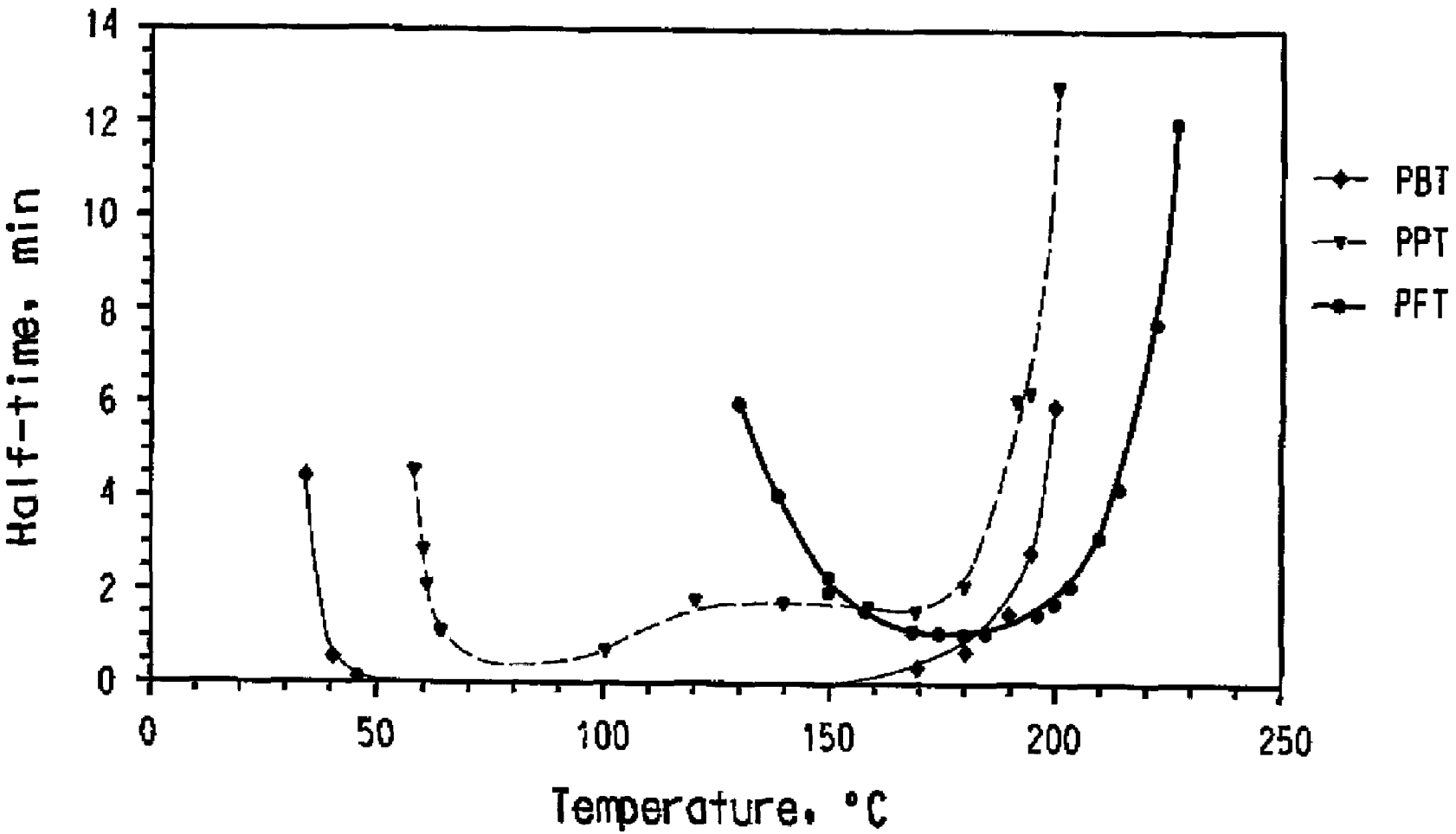
FIG. 4 is a graph of the isothermal crystallization half time data in Table 1 determined over a range of temperatures for each of the polymers employed in the examples.

The results are combined graphically in FIG. 4 to illustrate the extreme differences in crystallization behavior of the three polymers.

TABLE 1

| Crystallization Half Times | | | |
|---|---|---|---|
| Crystallization temp | PET | PPT | PBT |
| 37° C. | | | 4.42 min |
| 40° C. | | | 0.55 |
| 45° C. | | | 0.25 |
| 60° C. | | 4.47 min | |
| 62° C. | | 2.78 | |
| 63° C. | | 2.17 | |
| 64° C. | | 1.15 | |
| 100° C. | | 0.60 | |
| 120° C. | | 1.32 | |
| 130° C. | 5.93 min | | |
| 140° C. | 3.97 | 1.47 | |
| 150° C. | 2.18, 1.98 | | |
| 160° C. | 1.35, 1.17 | 1.33 | |
| 170° C. | 0.98 | 1.33 | 0.40 |
| 175° C. | 0.93 | | |
| 180° C. | 0.93 | 2.12 | 0.60 |
| 185° C. | 1.15 | | |
| 190° C. | | 6.20, 2.75 | 1.50 |
| 195° C. | 1.32 | 6.50 | 2.97 |
| 200° C. | 1.60 | 13.0 | 6.15 |
| 205° C. | 1.90 | | |
| 210° C. | 3.08 | | |
| 215° C. | 4.47 | | |
| 220° C. | 7.25 | | |
| 225° C. | 11.95 | | |

Intrinsic viscosity ("IV") of the polyesters was measured with a Viscotek Forced Flow Viscometer Model Y-900 at 19° C. and according to ASTM D-4603-96 but in a 0.4% concentration in a 50/50 wt % mixture of trifluoroacetic acid and methylene chloride. The measured viscosity was then correlated with standard viscosities in 60/40 wt % phenol/1,1,2,2-tetrachloroethane to arrive at the intrinsic viscosity values herein provided.

Crimp in the as spun fiber was developed and crimp contraction measured according to the following procedure. Each spun yarn was formed into a skein of 5000+/−5 total denier (5550 dtex) using a skein reel at a tension of about 0.1 gpd (0.09 dN/tex). The skein was then conditioned at 70+/−2° F. (21+/−1° C.) and 65+/−2% relative humidity for a minimum of 16 hours. The conditioned skein was hung vertically from a stand, a 500 gram weight (100 mg/d; 90 mg/dtex) was attached to the bottom of the skein, and the length of the skein was measured to a precision of 1 mm. This measurement of the as-spun length is referred to herein as the "initial length."

The 500 gram weight was then removed, and the sample was placed into an oven maintained at 160° C. and held there for 5 minutes to develop the crimp. The skein was then removed, and conditioned at 70+/−2° F. (21+/−1° C.) and 65+/−2% relative humidity for a minimum of 16 hours.

A 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as. "$C_b$". The 1.35 mg/dtex weight was left on the skein for the duration of the test. Next, a 500 gram weight (100 mg/d; 90 mg/dtex) was hung from the bottom of the skein, and the length of the skein was measured to within 1 mm and recorded as "$L_b$". Crimp contraction value (percent) (before heat-setting, as described below), "$CC_b$", was calculated according to the formula $$CC_b=100\times(L_b-C_b)/L_b$$

The 500-g weight was removed and the skein was then hung on a rack and heat-set, with the 1.35 mg/dtex weight still in place, in an oven for 5 minutes at about 250° F. (121° C.), after which the rack and skein were removed from the oven and conditioned as above for two hours. The length of the skein was again measured following the procedure hereinabove described, and its length was recorded as "$C_a$". The 500-gram weight was again hung from the skein, and the skein length was measured as above and recorded as "$L_a$". The after heat-set crimp contraction value (%), "$CC_a$", was calculated according to the formula $$CC_a=100\times(L_a-C_a)/L_a.$$

$CC_a$ is reported in the Tables.

Shrinkage is defined by:

$$\text{Shrinkage}=100\times(\text{Initial length}-La)/\text{Initial length}.$$

The fibers prepared according to preferred embodiments of the process of the invention are characterized by $CC_a$ above 30% and, most preferably, above 40%.

The indicated polymers were melted and extruded using a pair of Werner & Pfleiderer co-rotating 28-mm twin-screw extruders. The highest melt temperature attained in the PET extruder was about 280-285° C., and the corresponding temperature in the PPT extruder was about 265-275° C. The extruders fed gear pumps which metered the polymers to the spinneret assembly.

Yarns spun at speeds ≦2500 m/min were wound up on a Lessona Model 959 winder. Yarns spun at speeds ≧2500 m/min were wound up on a Barmag SW6 2s 600 winder (Barmag A G, Germany), having a maximum winding speed of 6,000 meters per minute.

The spinneret was a post-coalescence bicomponent spinneret having thirty-four pairs of capillaries arranged in a circle, an internal angle between each pair of capillaries of 300, a capillary diameter of 0.64 mm, and a capillary length of 4.24 m. The weight ratio of the two polymers in the fiber was 50/50. Total spun weight of the 34 filament yarn was approximately 33.4/minute. Yarn deniers were determined by the spin speed.

Examples 1 and 2, and Comparative Examples 1 to 7

A. 1,3-Propanediol was prepared by hydration of acrolein in the presence of an acidic cation exchange catalyst, according to the method disclosed in U.S. Pat. No. 5,171,898, to form 3-ydroxypropionaldehyde. The catalyst and any unreacted acrolein were separated out and the 3-hydroxypropionaldehyde was then catalytically hydrogenated using a Raney Nickel catalyst according to the method disclosed in U.S. Pat. No. 3,536,763. The product 1,3-propanediol was recovered from the aqueous solution and purified.

B. Poly(trimethylene terephthalate) was prepared from 1,3-propanediol and dimethylterephthalate ("DMT") in a two-vessel process using tetraisopropyl titanate catalyst, Tyzor® TPT (a registered trademark of E. I. du Pont de Nemours and Company) at 60 ppm, based on polymer. Molten DMT was added to the 1,3-propanediol and catalyst at 185° C. in a transesterification vessel, and the temperature was increased to 210° C. while methanol was removed. The resulting intermediate was transferred to a polycondensation vessel where the pressure was reduced to one millibar (10.2 g/cm$^2$), and the temperature was increased to 255° C. When the desired melt viscosity was reached, the pressure was increased and the polymer was extruded, cooled, and cut into pellets. The pellets were further polymerized in the solid-phase to an intrinsic viscosity of 1.04 dl/g in a tumble dryer operated at 212° C.

C. Poly(ethylene terephthalate) (Crystar® 4415, a registered trademark of E. I. du Pont de Nemours and Company), having an intrinsic viscosity of 0.54 dl/g, and poly(trimethylene terephthalate), prepared as in step B above, were melt-spun from as described hereinabove to form a bicomponent fiber. The PET extruder was set at 275° C. and the PPT extruder, at 260° C. The spinning head was held at 265° C.

The spinneret temperature was maintained at about 272° C. The spinneret was recessed into the top of the spinning column by 0.75 inch) so that the quench gas contacted the just-spun fibers only after a short delay. The quench gas was air, supplied at a room temperature of about 20° C. The height of the zone below the spinneret ("2" in FIG. 1) was 172 cm. The flow of quench air had the following profile, measured 5 inches (12.7 cm) from the distribution screen, along the average filament path.

TABLE 2

| Distance from spinneret (cm) | Air Speed (mpm) |
|---|---|
| 15 | 8.5 |
| 30 | 9.4 |
| 46 | 9.4 |
| 61 | 11.0 |
| 76 | 11.0 |
| 91 | 11.3 |
| 107 | 11.6 |
| 122 | 16.5 |
| 137 | 34.1 |
| 152 | 39.6 |
| 168 | 29.6 |

The fibers were passed over a pair of room temperature rolls at the bottom of the quench column, running at 2000 m/min, and wound up with a Lessona Model 959 constant tension winder.

The weight ratio of the two polymers in the fiber was 50/50. Total spun weight of the 34 filament yarn was approximately 33.4 g/minute.

The product yarn was also tested by differential scanning calorimetry (DSC). The apparatus was a T. A Instrument Model 2920MDSC, V2.5F, operating between −50 and 300° C., at 10 degrees/minute. Tc was taken as the peak of the exotherm immediately following the Tg, on the initial heat. The exotherm area was integrated based on the area above the baseline extension, measured in joules per gram.

Figure 5:
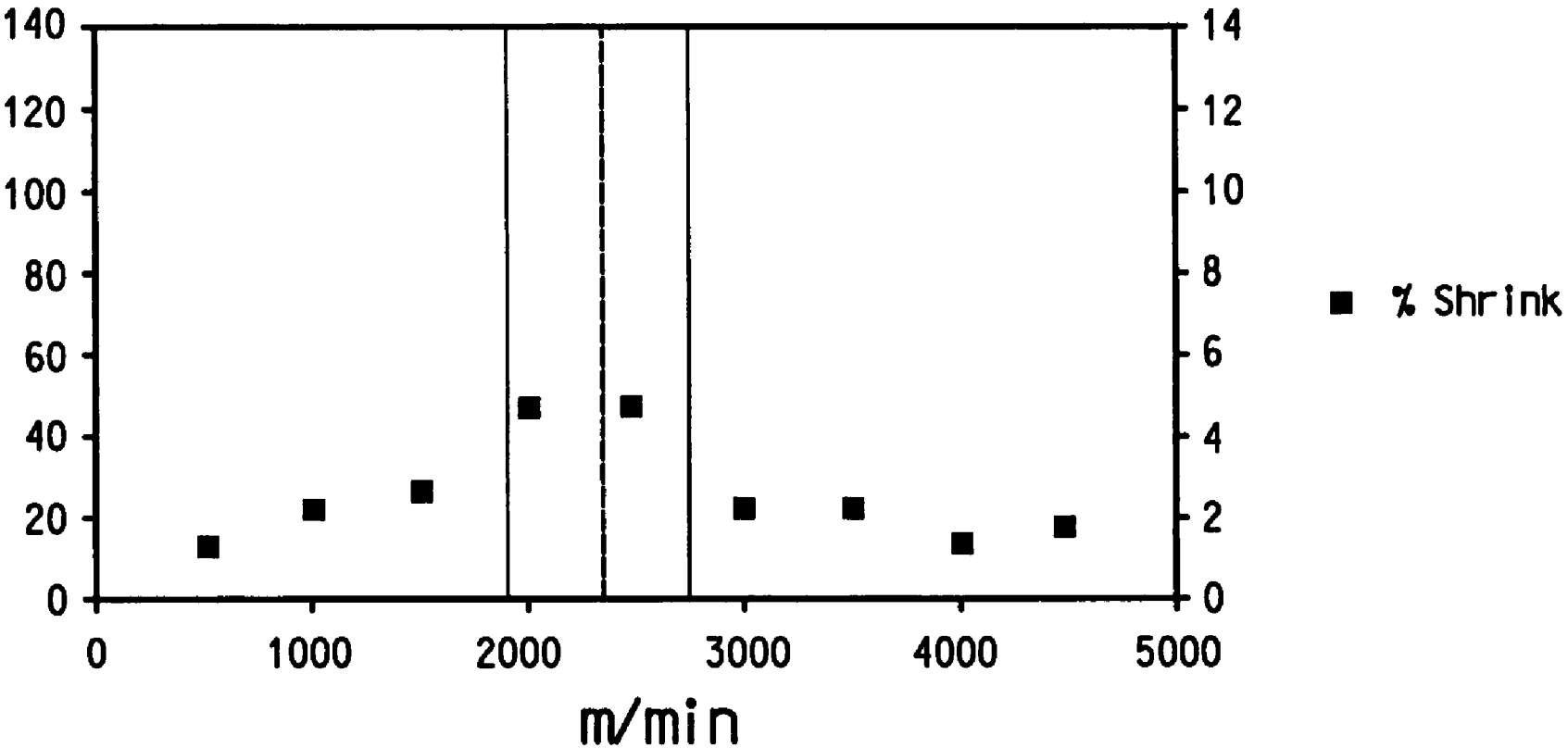
FIG. 5 is a graph of the data in Table 3 for PET/PPT bicomponent fibers showing the maximum shrinkage spinning rate and the dependency of shrinkage upon spinning speed.

Example 1 was prepared and tested as described above, and spun at 2000 m/min. Example 2 and Comparative Examples 1 to 7 were prepared and tested employing the materials and procedures of Example 1 except that the wind-up (W/U) speeds were varied as shown in Table 3 below. Table 3 shows the resulting crimp contraction ($CC_a$), cold crystallization temperature, and heat of crystallization for each example. FIG. 5 is a plot of the data in Table 3. The MSSR lies in the region between 2000 and 2400 meters per minute.

Examples 3 and 4 and Comparative Examples 8-12

Figure 6:
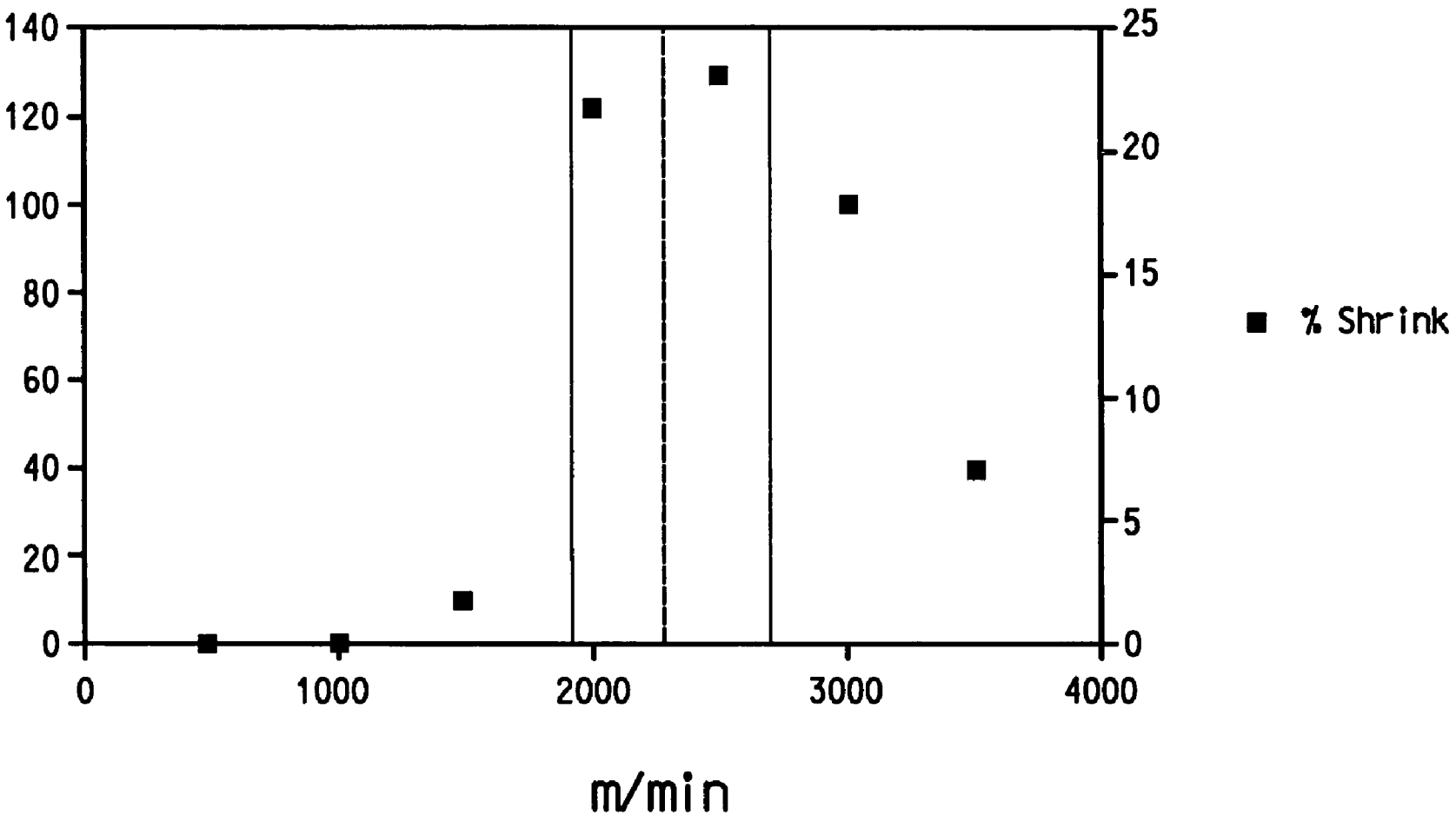
FIG. 6 is a graph of the data in Table 4 for PET/PBT bicomponent fibers showing the maximum shrinkage spinning rate and the dependency of shrinkage upon spinning speed.

Examples 3 and 4 and Comparative Examples 8-12 were executed in the same manner as Example 1 with the exception that poly(butylene terephthalate) was substituted for the poly (propylene terephthalate). Results are shown in Table 4 and plotted in FIG. 6. The MSSR lies approximately at 2300 meters per minute.

Examples 5 and 6 and Comparative Examples 13-19

Figure 7:
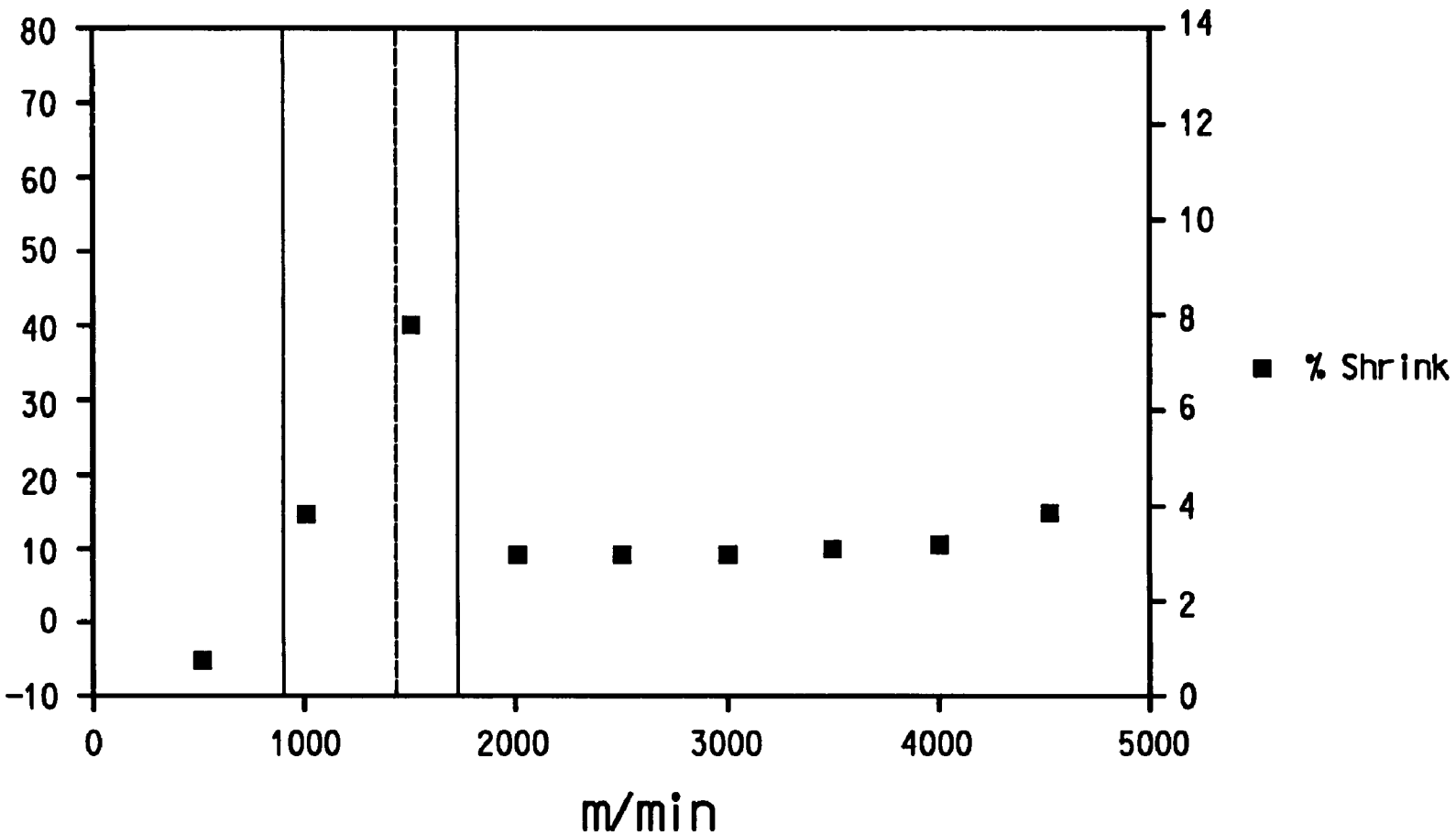
FIG. 7 is a graph of the data in Table 5 for PPT/PBT bicomponent fibers showing the maximum shrinkage spinning rate and the dependency of shrinkage upon spinning speed.

Examples 5 and 6 and Comparative Examples 13-19 were executed in the same manner as Example 1 with the exception that poly(butylene terephthalate) was substituted for the poly (ethylene terephthalate). Results are shown in Table 5 and plotted in FIG. 7. The MSSR lies at approximately 1400 meters per minute.

What is claimed is:

1. A process for preparing polyester bicomponent fibers the process comprising combining at least two crystallizable polyester polymers, determining a maximum shrinkage spinning rate of said polymers, melting said polyester polymers, causing said molten polymers to flow through a spinneret having one or more apertures, said spinneret being suitable for preparing bicomponent fibers, thereby spinning at least one strand of 0.5 to 6 denier fiber said strand being spun at a linear rate of ±10% of the maximum shrinkage spinning rate, said two crystallizable polyester polymers differing from one another in crystallization rate under the spinning conditions.

2. The process of claim 1 wherein the at least two crystallizable polyester polymers are selected from the group consisting of polyethylene terephthalate, polypropylene terephthalate, and polybutylene terephthalate.

3. The process of claim 2 wherein one crystallizable polyester polymer is polyethylene terephthalate, and another crystallizable polyester polymer is polypropylene terephthalate.

4. The process of claim 2 or claim 3 wherein the weight ratio of the two polyesters in the bicomponent fibers made by the process of the invention is in the range of 30/70-70/30.

5. The process of claim 2 or claim 3 wherein the weight ratio of the two polyesters in the bicomponent fibers made by the process of the invention is in the range of 40/60-60/40.

6. The process of claim 2 or claim 3 wherein the weight ratio of the two polyesters in the bicomponent fibers made by the process of the invention is in the range of 45/55-55/45.

7. The process of claims 1, 2, or 3 wherein the at least two crystallizable polyester polymers differ in intrinsic viscosity.

8. The process of claim 1 or claim 3 further comprising the step of heating the thus prepared polyester bicomponent to a temperature above the glass-transition temperature of the less crystallized component to effect shrinkage and crimping of said fiber.

* * * * *